United States Patent [19]

Filatov et al.

[11] 3,959,999

[45] June 1, 1976

[54] METHOD OF PRODUCING LONG-LENGTH ARTICLES FROM HOT-ROLLED CARBON STEEL AND ARTICLE PRODUCED THEREBY

[75] Inventors: Nikolai Grigorievich Filatov, Orel; Vitaly Nikiforovich Gridnev; Valentin Gennadievich Gavriljuk, both of Kiev; Jury Yakovlevich Meshkov, Kiev; Felix Isaakovich Mashlenko; Konstantin Vasilievich Mikhailov, both of Moscow; Valery Ionovich Fedorov; Vladimir Zakharovich Marchenko, both of Volgograd; Ivan Konstantinovich Lyskov; Viktor Alexandrovich Budilovsky, both of Volgograd, all of U.S.S.R.

[73] Assignees: Ivan Konstantinovich Lyskov; Viktor Alexandrovich Budilovsky, both of U.S.S.R.

[22] Filed: Nov. 1, 1974

[21] Appl. No.: 520,215

[52] U.S. Cl. ..... 72/364; 72/200; 72/700; 148/12 B

[51] Int. Cl.[2] ..... B21C 9/00; B21D 31/00; C21D 7/02

[58] Field of Search ..... 72/200, 201, 202, 342, 72/364, 700; 148/12 B

[56] References Cited

UNITED STATES PATENTS

| | | | |
|---|---|---|---|
| 3,580,746 | 5/1971 | Behar | 148/12 B |
| 3,699,797 | 10/1972 | Tournoy | 148/12 B |
| 3,877,281 | 4/1975 | Shimizu et al. | 148/12 B |

FOREIGN PATENTS OR APPLICATIONS

| | | | |
|---|---|---|---|
| 2,104,771 | 9/1971 | Germany | 148/12 B |

*Primary Examiner*—C. W. Lanham
*Assistant Examiner*—E. M. Combs
*Attorney, Agent, or Firm*—Holman & Stern

[57] ABSTRACT

A method of producing long length articles from hot-rolled carbon steel is disclosed. A distinctive feature of the method, is that the operations of cold and warm plastic deformation of a wire rod alternate in succession at least twice.

3 Claims, 2 Drawing Figures

METHOD OF PRODUCING LONG-LENGTH ARTICLES FROM HOT-ROLLED CARBON STEEL AND ARTICLE PRODUCED THEREBY

BACKGROUND OF THE INVENTION

The present invention concerns a method of producing long-length articles from hot-rolled carbon steel, such as, wire, strip and rolled sections.

Methods of producing long-length articles from hot-rolled steel, such as high-strength wire, are well known in the prior art. For example, a hot-rolled wire rod is first subjected to heat treatment, whereupon the surface of the heat-treated rod is prepared for subsequent deformation by descaling and applying a sublubricant coat of lime, borax or copper. The rod is then subjected to cold plastic deformation, such as drawing, to obtain wire of a requisite cross-section.

Heat-treating is employed for obtaining a metal structure which would enable subsequent cold deformation, accomplished in stages, to be effected with heavy overall reductions (up to 75–90%) which are needed to provide a preassigned strength.

To prevent wire embrittlement, cold plastic deformation is alternated with additional heat-treating operations (annealing or patenting).

Depending on the designation of high-strength wire, the heat-treating operations (normalizing, patenting or quenching with subsequent tempering) as well as cold plastic deformation schedules, pass or overall reductions in particular, may vary during drawing.

In a number of cases the long-length articles — wire — are produced by only heat-treating the wire rod, e.g. by quenching with subsequent tempering, bainitizing, etc. However, wire made in the above manner, featuring perfect elongation and relaxation resistance, corrodes readily and has inadequate strength.

The wire produced by the use of only cold plastic deformation without preliminary heat treatment (such as patenting) possesses an adequate strength but has a very low state of plastic characteristics. Moreover, the drawing of such wire often leads to breaks because of its enhanced brittleness.

Known in the art is a method of producing long-length articles by plastic deformation of wire rods with simultaneous heating. Usually the above method is applicable to the so-called "hard-to-work" high-alloy (with chromium, titanium or tungsten) steels. However, in the case of using carbon steel as well, the metal should be always subjected to a preliminary heat-treating operation — annealing or normalizing.

When producing reinforcement high-strength wire, low-temperature tempering is used as a final operation to increase its ductility.

Also known is a method which consists essentially in that the long-length articles — wire — after preliminary heat-treating (patenting) and subsequent cold deformation are subjected to axial tension and concurrent heating to a temperature within the range of 300–400°C. The latter operation, during which the processes of polygonization and blocking of dislocations by admixture atoms (nitrogen, oxygen, carbon) take place, contributes to the enhancement of rheological properties (relaxation resistance) of reinforcement and spring wire (see, e.g. British Pat. Nos. 748357, 969191, 969192. The wire subjected to the above operation features high physicomechanical characteristics and rheological properties.

Similar properties are obtainable by a more efficient method, wherein immediately after the last cold plastic deformation of a heat-treated (patented) wire rod, it is subjected to a subsequent plastic deformation combined with concurrent heating to a temperature within a range of 350°–500°C and axial tension.

This operation of the plastic deformation of wire heated concurrently to a temperature in the 300°–600°C range will be referred to as warm deformation.

Thus, all the known methods of producing high-strength wire are always characterized by heat-treatment of wire rod prior to drawing. The heat-treating operation is conducted on cumbersome and low efficiency equipment in heat-treating departments, and plastic deformation (drawing) is conducted in drawing shops. This fact creates considerable time loss and a high cost of in- or intrashop transportation resulting in a reduction in labour productivity and an increase in production cost.

SUMMARY AND OBJECTS OF THE INVENTION

The main object of the invention is the provision of a method of producing long-length articles from hot-rolled carbon steel which would make it possible to substantially facilitate the process of production of the articles, enhance productivity and economic efficiency of production as a whole, with the article retaining high physicomechanical and rheological characteristics.

This and other objects are achieved by that in producing long-length steel articles, preferably wire, from hot-rolled carbon steel by cold plastic deformation and subsequent plastic deformation of a wire rod with concurrent heating to a temperature range of from 300° to 600°C effected after preliminary operations comprising descaling and applying a sublubricant coat, according to the invention, the operations of cold plastic deformation of the wire rod and its plastic deformation with concurrent heating are alternated at least twice.

The above method is suitable for the manufacture of articles of a diversified profile, such as wire, strip and other long-length shaped members.

It is expedient that cold plastic deformation be accomplished with a 40–50% shrinkage or reduction degree and plastic deformation with a concurrent heating with a 5–25% reduction degree.

BRIEF DESCRIPTION OF THE DRAWINGS

The detailed description of the present invention should be read in conjunction with the accompanying drawings, wherein.

DETAILED DESCRIPTION OF THE INVENTION

The essence of the present invention resides in the following.

Figure 1:
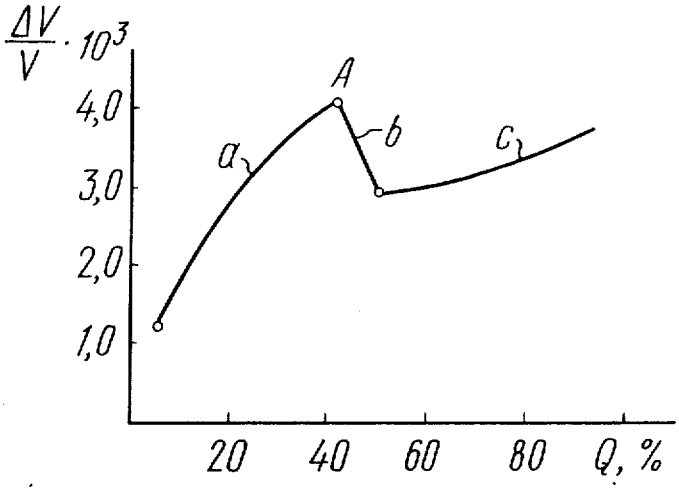
FIG. 1 shows the influence of an increment in steel volume ($\Delta V/V$) on the amount of plastic deformation (Q)

As it is known, cold plastic deformation of steel is accompanied by the appearance of defects, i.e., an accumulation of dislocations bringing about microstresses in a lattice and microcracks which adversely affect the plastic characteristics of the steel. We have established that the defects are accumulated in stages. At the first stage, deformation with an overall reduction of up to 40–50% gives rise preferably to spot and linear defects, and no considerable amount of microcracks are observed. The accumulation of linear defects (dislocations) results in microstresses which cause metal embrittlement. This is displayed by a considerable increase in metal volume (section *a* in FIG. 1). With an overall reduction of 40–50% (II stage) the microstresses attain their maximum value (point A in FIG. 1) and further deformation results in a high-rate occurence of microcracks accompanied by relaxation of microstresses. The process corresponds to a reduction in the steel volume (section *b* in FIG. 1), insofar as a surplus volume brought about by the cracks is less than the volume increment resulting from microstresses. Steel deformation with the overall reduction exceeding 40–50% (section *c*) will again cause a growth in microstresses in the presence of the numerous microcracks set up earlier. This is revealed perfectly by microscopic investigations. The occurrence of microcracks in cold-worked steel diminish its ductility, and all the known technological procedures (heat-treating, especially, intermediate, small pass reductions, decreased drawing rates) are actually aimed at the prevention or reduction in the rate of occurrence of the microcracks with a view to enhancing plastic characteristics of metal.

Figure 2:
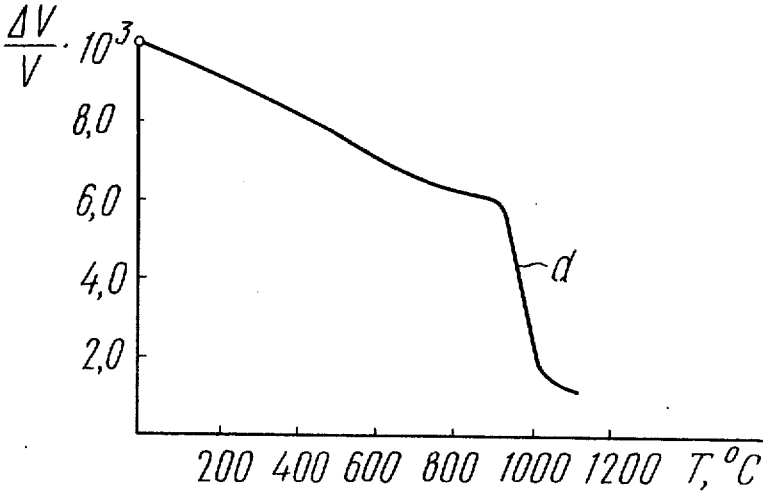
FIG. 2 is a graphical illustration showing an increment in the volume ($\Delta V/V$) of cold-worked steel versus the heating temperature (T) during heat treatment.

The elimination of the microcracks brought about by the cold plastic deformation is attainable only by heating the metal to temperatures in excess of $\alpha \quad \beta$ transformation (900°–1000°C, section *d* of the curve in FIG. 2); but this eliminates completely the strengthening obtained during the deformation. Neither tempering under stress, nor warm deformation envisaged by the known procedures are capable of eliminating the microcracks.

However, the relaxation of microstresses effected at a stage of cold deformation prior to the mass occurrence of the cracks (i.e. with the overall reduction of up to 40–50%) makes it possible to prevent the cracks or at least to limit substantially the rate of their occurrence and, hence, to preserve a plasticity margin in the metal ensuring thereby the possibility of its further cold formation and strengthening. To this end the herein-proposed method comprises an at least two-fold alternation of the cold and warm deformation of the metal directed to obtain a maximum reduction in the number of defects and enhancement of its plastic characteristics. The total number of cycles of the cold and warm deformation is determined by the requisite degree of strengthening of the finished product. The alternation of the cold and warm deformation is efficient with any overall reductions. However, maximum efficiency is achieved when the amount of cold deformation does not exceed 50%; whereby, the microcracks which can be removed, as it was stated above, only by high-temperature heating, do not arise in mass quantities.

Apart from the relief of microstresses and prevention of microcracks associated therewith and leading to an enhancement of plasticity, the alternation of the cold and warm deformation results in a reduction in microstresses and in their redistribution, whereby residual compression stresses arise on the surface of the article enhancing its rheological properties and corrosion resistance.

It would be sound practice for the warm plastic deformation to be effected with a 5–25% reduction; the efficiency of the herein-proposed method diminishes abruptly at a decrease in shrinkage owing to insufficient relaxation of stresses. Reductions in excess of 25% are hardly attainable technologically during the warm plastic deformation and do not provide a substantial enhancement of quality.

Thus, the successive alternation of the cold and warm deformation makes it possible to eliminate such a labor-consuming and low-efficient technological operation as heat treatment of a wire rod which is mandatory before the plastic deformation according to all the known procedures for producing long-length articles. This enables a substantial enhancement of the process efficiency and total economic effectiveness in the manufacture of such articles as, for example, high-strength wire, by using only high-production drawing or rolling equipment and excluding the handling operations.

Hence, the proposed method makes it possible to qualitatively change and facilitate the existing production of the long-length steel articles and to obtain an article, such as wire, featuring high physicomechanical and rheological characteristics.

For a better understanding of the essence of the present invention, given hereinbelow are examples illustrating embodiments of the proposed method.

EXAMPLE 1

Starting material: hot-rolled steel in the form of wire, 8 mm in diameter, containing 0.69% of carbon. The wire was etched after which; its surface was then coated with a copper sublubricant layer. The wire prepared in the above manner was subjected to cold drawing on a drawing machine at a rate of 60 m/min in several passes with an overall draft of 40% with an ensuring reduction in the wire diameter to 6.2 mm and an enhancement in its strength to 127–129 kg/mm², its breaking elongation being equal to 0.5%. Next the wire was heated to a temperature of 370°C and drawn with the same speed through a 5.9 mm die (the pass reduction amounted to 10%).

The production rate of the proposed method was determined by a drawing speed. The wire strength after the warm deformation amounted to 130–133 kg/mm², elongation was 4.5%. After that, the cold and warm drawing operations with the above reduction degrees were repeated twice. The results of mechanical tests of the wire after the different operations are tabulated in Table 1.

Table 1

| No | Name of operation | Diameter of wire produced, mm | Reduction degree,% | Tensile strength kg/mm² | Elongation, % | Stress relaxation during 1000hr, % |
|---|---|---|---|---|---|---|
| 1 | 2 | 3 | 4 | 5 | 6 | 7e |
| 1. | Cold drawing | 6.2 | 40 | 127–129 | 0.5 | |
| 2. | Warm drawing | 5.9 | 10 | 130–133 | 4.5 | |
| 1 | 2 | 3 | 4 | 5 | 6 | 7 |
| 3. | Cold drawing | 4.6 | 40 | 160–162 | 0.5–1.0 | |
| 4. | Warm drawing | 4.4 | 10 | 164–166 | 5.0 | |
| 5. | Cold drawing | 3.4 | 40 | 190–195 | 0.5–1.0 | |
| 6. | Warm drawing | 3.2 | 10 | 194–200 | 5.0–6.0 | 1.5–2.0 |

It could be seen from the table that the wire produced by the proposed method had high characteristics.

EXAMPLE 2

Hot-rolled steel with 0.78% of carbon in the form of a rod 8.0 mm in diameter, wound in a coil 500 kg in weight, was dipped in a pickling bath for descaling. Upon washing and drying, it was placed into a copper sulfate bath to apply a sublubricant layer. The preparatory operations being completed, the coil, ready for cold deformation, was conveyed to a drawing department, where it was subjected to cold plastic deformation on a drawing machine to a 6.3 mm diameter with an overall reduction of 38%. Following that, warm deformation was effected in single pass at a temperature of 420°C. On being subjected to the warm deformation, the rod 6.0 mm in diameter was passed to a rolling mill to be rolled into a strip, at a rate of 300 m/min. After a number of cold passes it reached a final dimension of 10×2 mm at a temperature of 350°C. An article produced by the herein-proposed method - a strip measuring 10×2 mm for the machine-building industry-featured a tensile strength of 170–175 kg/mm$^2$ and its elongation was equal to 5.0–6.0%.

Thus, the above examples prove that the proposed facilitates the production technique and ensures high production rates and perfect physicomechanical characteristics.

What we claim is:

1. A method of producing long-length articles from hot-rolled carbon steel, consisting essentially of the steps of:

a. descaling a wire rod of hot-rolled carbon steel;

b. applying a sublubricant coating to said descaled rod;

c. cold plastic deforming said rod within a range from a minimum effective amount to not more than 40–50% deformation whereby said deformation produces microstresses in said rod but is insufficient to cause microcracks in the surface of said rod;

d. warm plastic deforming said rod from (c) with concurrent heating of said rod to a temperature within the range 300°–600°C; and e. repeating steps (c) and (d) at least once.

2. The method of claim 3 wherein said steps (c) and (d) are repeated at least twice.

3. The method of claim 1, wherein the amount of plastic deformation of the wire rod with concurrent heating ranges within 5–25%.

* * * * *